US012788104B2

(12) United States Patent
Gono et al.

(10) Patent No.: US 12,788,104 B2
(45) Date of Patent: Nov. 10, 2026

(54) SHOE

(71) Applicant: ASICS Corporation, Kobe (JP)

(72) Inventors: Rikuto Gono, Kobe (JP); Yoshikazu Mitsuhata, Kobe (JP); Keishi Kitamoto, Kobe (JP); Naoki Sakajo, Kobe (JP)

(73) Assignee: ASICS Corporation, Kobe (JP)

( * ) Notice: Subject to any disclaimer, the term of this patent is extended or adjusted under 35 U.S.C. 154(b) by 0 days.

(21) Appl. No.: 19/353,484

(22) Filed: Oct. 8, 2025

(65) Prior Publication Data

US 2026/0101961 A1 Apr. 16, 2026

(30) Foreign Application Priority Data

Oct. 16, 2024 (JP) ..... 2024-180870

(51) Int. Cl.
*A43B 13/14* (2006.01)

(52) U.S. Cl.
CPC ..... *A43B 13/141* (2013.01)

(58) Field of Classification Search
CPC ..... A43B 13/141
USPC ..... 36/102
See application file for complete search history.

(56) References Cited

U.S. PATENT DOCUMENTS

| | | | | |
|---|---|---|---|---|
| D531,788 | S * | 11/2006 | Rittberg | D2/960 |
| 9,668,542 | B2 * | 6/2017 | Lawless | A43B 13/141 |
| 9,717,303 | B2 * | 8/2017 | Walker | A43B 13/223 |
| 2008/0216355 | A1 * | 9/2008 | Becker | A43B 13/181 36/102 |
| 2011/0035963 | A1 * | 2/2011 | Baker | A43B 13/40 36/114 |
| 2016/0007676 | A1 | 1/2016 | Leimer et al. | |

FOREIGN PATENT DOCUMENTS

| | | | | |
|---|---|---|---|---|
| JP | 2016-016329 | A | 2/2016 | |
| WO | 2018/193489 | A1 | 10/2018 | |
| WO | WO-2020186311 | A1 * | 9/2020 | A43B 13/14 |

* cited by examiner

*Primary Examiner* — Ted Kavanaugh
(74) *Attorney, Agent, or Firm* — Studebaker Brackett PLLC

(57) ABSTRACT

A shoe (300) according to the present embodiment includes: a first groove portion (111) that extends forward from a medial foot side toward a lateral foot side on a bottom surface (112) of a sole (100); and a second groove portion (122) that extends forward from a bottom surface side toward an upper surface side of the sole (100) on a medial-foot-side side surface (124) of the sole (100), in which a groove width at a medial-foot-side end portion (111*a*) of the first groove portion (111) and a groove width at a bottom-surface-side end portion (122*a*) of the second groove portion (122) at least partially overlap with each other along a direction of a boundary between the bottom surface (112) and the medial-foot-side side surface (124).

11 Claims, 7 Drawing Sheets

SHOE

CROSS-REFERENCE TO RELATED APPLICATION

This application claims priority to Japanese Patent Application No. 2024-180870, the disclosures of which are incorporated herein by reference in their entirety.

BACKGROUND

Technical Field

The present invention relates to a shoe.

Background Information

Various ideas are applied to shoes depending on the intended use. For example, in mountaineering shoes, trail running shoes, climbing shoes, and the like, a technique for connecting an upper to an outsole without using a bonding agent in order to enhance the safety and durability is known (refer to, for example, Japanese Unexamined Patent Application Publication No. 2016-016329).

SUMMARY

When the intended use of shoes is further limited, for example, when mountaineering shoes and trail running shoes are compared with each other, functions required for them are different from each other. In trail running, a wearer of shoes runs on an uneven ground on which stone blocks, twigs, and the like are scattered. Therefore, unlike mountaineering shoes having a hard and thick sole so as not to be affected by bumps and dips on the road surface, trail running shoes preferably have a sole which flexibly deforms to follow the change of the road surface for successive steps.

The present disclosure has been made in order to solve such a problem, and an object of the present disclosure is to provide a shoe capable of, when a wearer runs on an uneven ground, releasing impact from the ground to the foot and maintaining the horizontal position of the ankle to obtain good controllability.

A shoe according to a specific aspect of the present disclosure includes: a first groove portion that extends forward from a medial foot side toward a lateral foot side on a bottom surface of a sole; and a second groove portion that extends forward from a bottom surface side toward an upper surface side of the sole on a medial-foot-side side surface of the sole, in which a groove width at a medial-foot-side end portion of the first groove portion and a groove width at a bottom-surface-side end portion of the second groove portion at least partially overlap with each other along a direction of a boundary between the bottom surface and the medial-foot-side side surface.

According to the present disclosure, a shoe capable of, when a wearer runs on an uneven ground, releasing impact from the ground to the foot and maintaining the horizontal position of the ankle to obtain good controllability can be provided.

DETAILED DESCRIPTION

Figure 1:
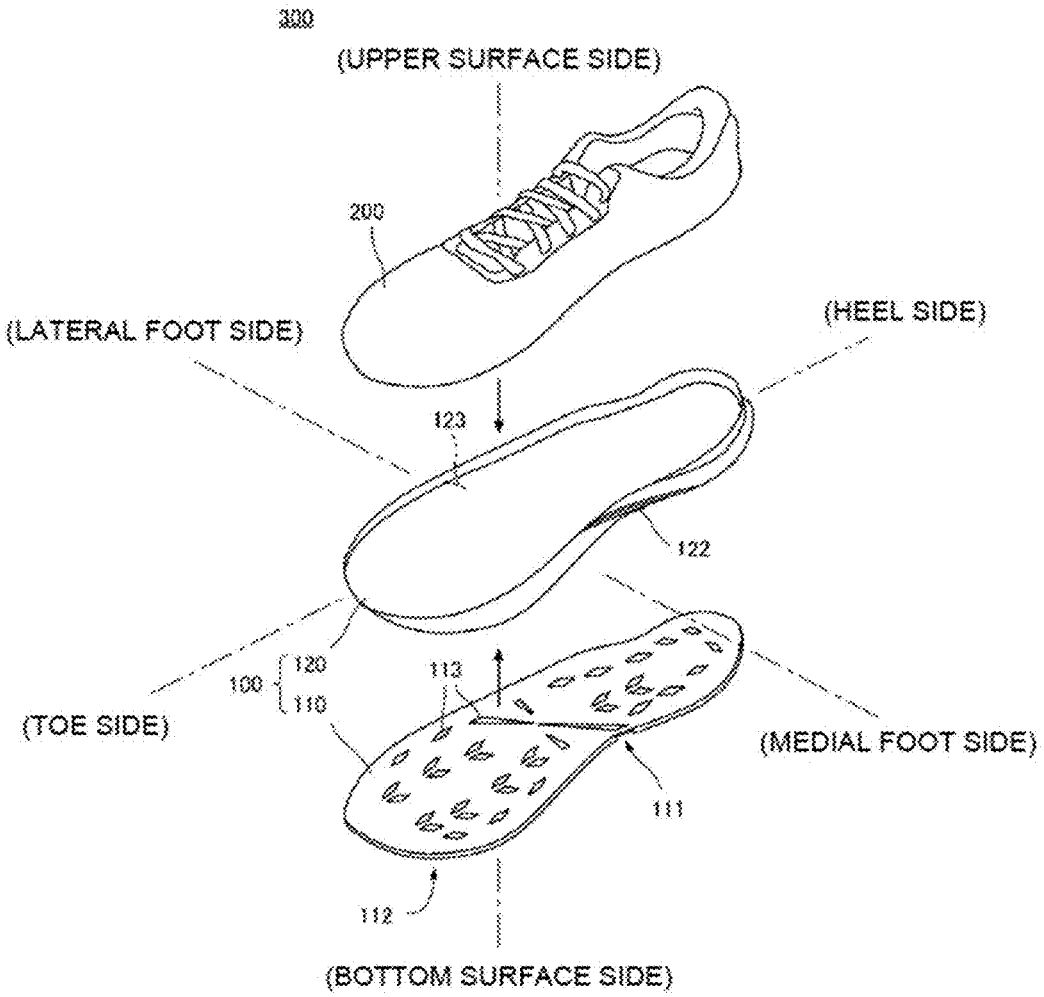
FIG. 1 is an exploded perspective view illustrating an appearance of a shoe according to the present embodiment.

Specific embodiments will be described through the following disclosure, but the invention according to the claims is not limited to the following embodiments. In addition, all of the configurations described in the embodiments are not necessarily essential as means for solving the problem. In the drawings, the same or similar components are denoted by the same reference numerals, and duplicate explanations are omitted.

FIG. 1 is an exploded perspective view illustrating an appearance of a shoe 300 according to the present embodiment. The shoe 300 according to the present embodiment is mainly intended for trail running. The shoe 300 has a sole 100 and an upper 200. The sole 100 has a two-layer structure of an outsole 110 as a first layer arranged on the bottom surface side and a midsole 120 as a second layer laminated on the upper surface of the outsole 110. An insole that is in contact with the bottom of the wearer's foot may be laminated on the sole 100. The upper 200 is bonded or stitched to the periphery of the midsole 120 to cover the top of the wearer's foot.

The outsole 110 is provided with a first groove portion 111, which will be described in detail below, on the side of a bottom surface 112 facing the ground. Moreover, the outsole 110 has a plurality of through holes 113 formed into a polygonal shape for the purpose of weight reduction and design. The outsole 110 is formed of a synthetic rubber such as SBR (styrene-butadiene rubber).

The midsole 120 is provided with a second groove portion 122 and a third groove portion 123, which will be described in detail below, on the circumferential side surface. Depending on the required degree of bending, a configuration in which only the second groove portion is provided in the midsole 120 without providing the third groove portion may be adopted. The midsole 120 is formed of an elastic material such as a foam material. For example, EVA resin (ethylene-vinyl acetate copolymer resin) or the like is suitable for the material of the midsole 120.

Although FIG. 1 illustrates only the right shoe 300, needless to say, the left and right shoes 300 forms a pair. Also in the following description, the shoe 300 will be described on the right foot side as a representative. Since the configuration of the left foot side is symmetrical to the configuration of the right foot side, the description thereof will be omitted. In addition, as illustrated in the drawings, in the present embodiment, when a wearer wears the shoe 300, a side on which a toe is positioned is referred to as a toe side, and a side on which a heel is positioned is referred to as a heel side. The toe side may also be referred to as the front side or forward, and the heel side may also be referred to as the rear side or rearward. Similarly, a side on which a medial foot is positioned is referred to as a medial foot side, and a side on which a lateral foot is positioned is referred to as a lateral foot side. A direction connecting the medial foot side and the lateral foot side may be referred to as a foot width direction. Similarly, a side in contact with the ground is referred to as a bottom surface side, and an opposite side is referred to as an upper surface side.

Figure 2:
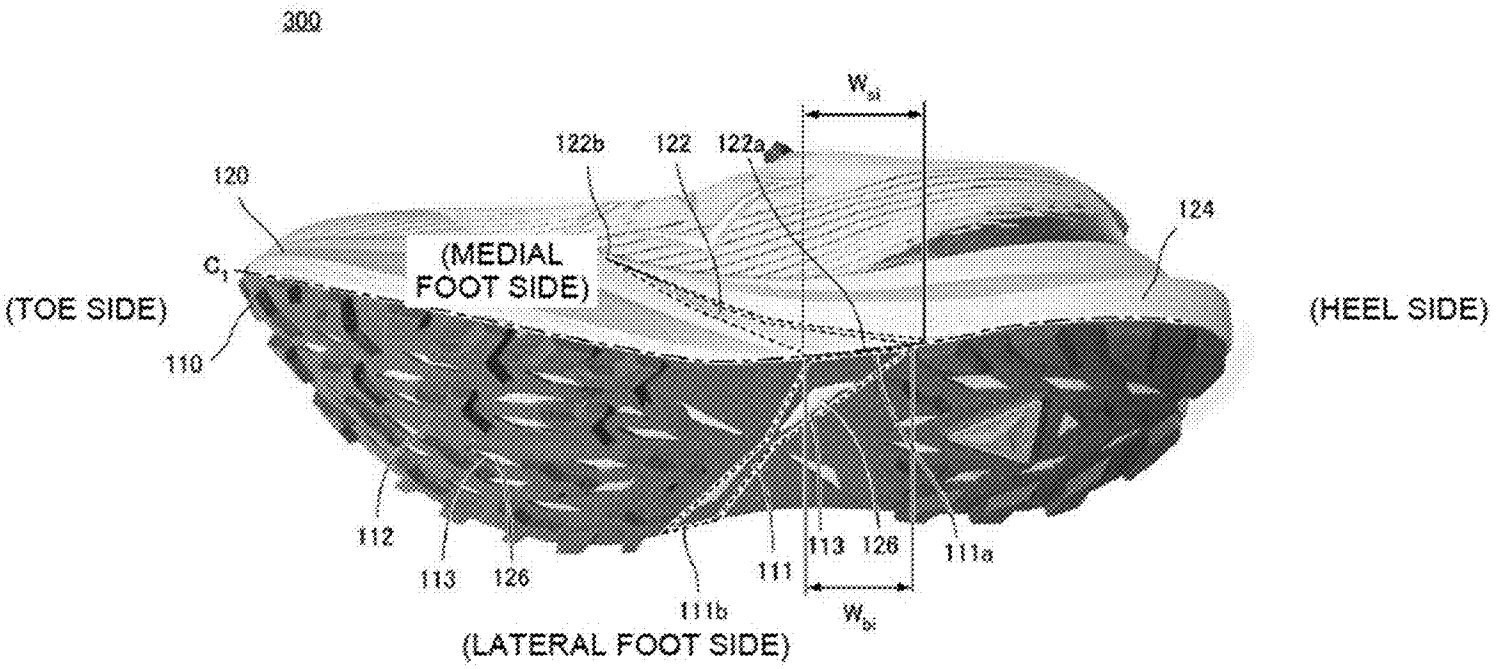
FIG. 2 is a perspective view of the shoe as viewed from the medial foot side.

FIG. 2 is a perspective view of the shoe 300 as viewed from the medial foot side. The first groove portion 111 is provided on the bottom surface 112 of the outsole 110 so as to traverse obliquely and horizontally the vicinity of the center thereof. The first groove portion 111 is a concave portion formed such that the thickness of the outsole 110 in the first groove portion 111 is thinner than that in the surrounding area. More specifically, the first groove portion 111 extends forward from a medial-foot-side end portion 111*a* positioned at the end portion on the medial foot side toward a lateral-foot-side end portion 111*b* positioned at the end portion on the lateral foot side. When an external force is applied in a twisting direction, the outsole 110 bends relatively easily with the first groove portion 111 as a bending line.

In the present embodiment, in consideration of design, the outline of the first groove portion 111 is formed into a polygonal shape in which two triangles share vertexes as indicated by the dotted line. As described above, the plurality of through holes 113 are provided in the outsole 110. When the outsole 110 is overlaid on the midsole 120, the surface of the midsole 120 appears as exposed portions 126 through the through holes 113. In the present embodiment, from the viewpoint of design, the through holes 113 are also provided in a region surrounded by the outline of the first groove portion 111, and the exposed portions 126 thereof form the first groove portion 111 as groove bottom surfaces. From the viewpoint of functionality, the first groove portion 111 may have a linear outline or a quadrangular outline, and the through holes 113 may not be provided in the range of the outline.

In the circumferential side surface of the midsole 120, the second groove portion 122 is provided on a medial-foot-side side surface 124 on the medial foot side so as to traverse obliquely and vertically the vicinity of the center thereof. The second groove portion 122 is a concave portion formed by being dug down from the surrounding area in the foot width direction of the midsole 120. More specifically, the second groove portion 122 extends forward from a bottom-surface-side end portion 122*a* positioned at the end portion on the bottom surface side of the midsole 120 toward an upper-surface-side end portion 122*b* positioned at the end portion on the upper surface side of the midsole 120. When an external force is applied in a twisting direction, the midsole 120 bends relatively easily with the second groove portion 122 as a bending line. When the second groove portion 122 reaches the upper-surface-side end portion 122*b*, the midsole 120 bends more easily.

In the present embodiment, in consideration of design, the outline of the second groove portion 122 is formed into a triangular shape with the bottom surface side as the base as indicated by the dotted line. From the viewpoint of functionality, the second groove portion 122 may have a linear outline or a quadrangular outline.

A groove width $W_{bi}$ at the medial-foot-side end portion 111*a* of the first groove portion 111 and a groove width $W_{si}$ at the bottom-surface-side end portion 122*a* of the second groove portion 122 are set so as to at least partially overlap with each other along a direction of a boundary line $C_1$ (indicated by the dash-dotted line) between the bottom surface 112 of the outsole 110 and the medial-foot-side side surface 124 of the midsole 120. In other words, the medial-foot-side end portion 111*a* of the first groove portion 111 and the bottom-surface-side end portion 122*a* of the second groove portion 122 share a part of the boundary line $C_1$ with each other. Sharing a part of the boundary line $C_1$ with each other is not limited to the case where the end portions of the two groove portions are at least partially continuously connected to each other, and even in the case where the end portions are not continuously connected to each other, the end portions may be at least partially opposed to each other with the boundary line $C_1$ interposed therebetween. In the case where such a relationship is satisfied, when an external force is applied in a twisting direction to the sole 100 in which the outsole 110 and the midsole 120 are laminated, stress is concentrated on the first groove portion 111 and the second groove portion 122, and the sole 100 is relatively easily twisted along the groove portions.

Figure 3:
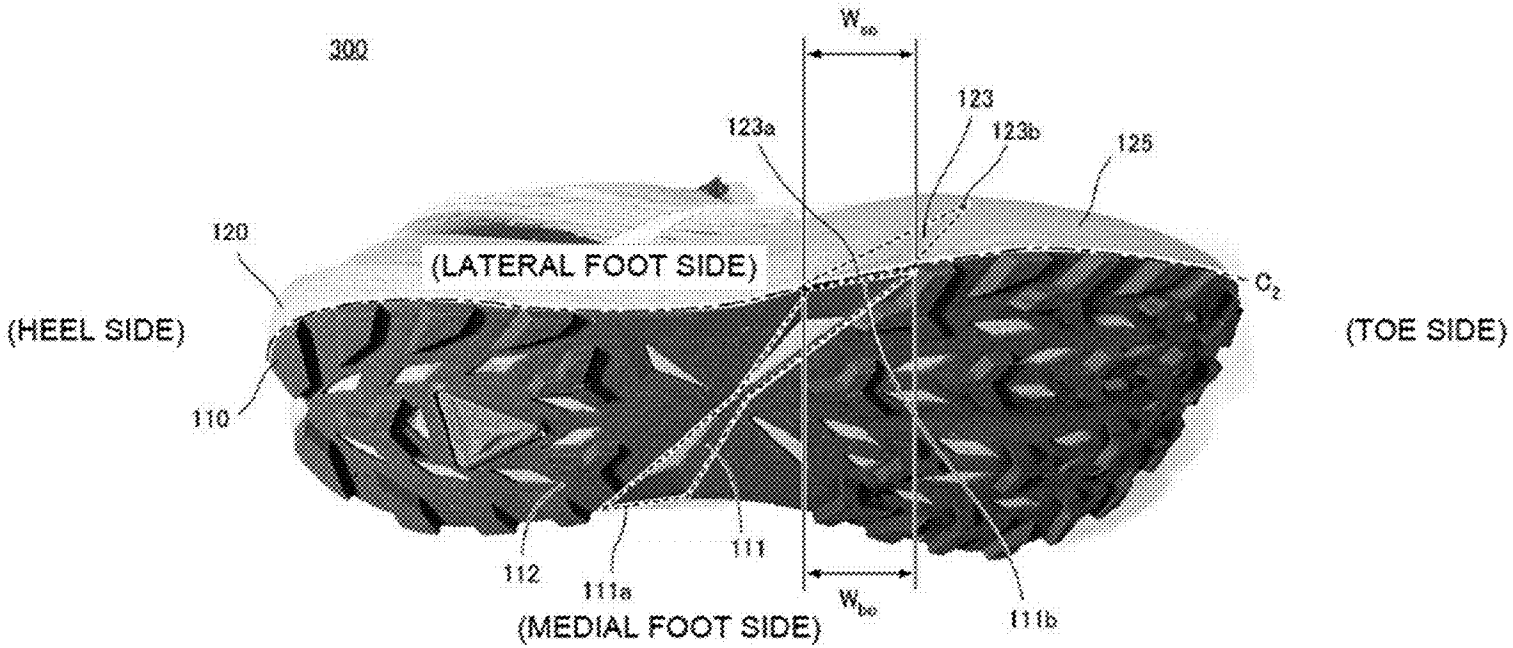
FIG. 3 is a perspective view of the shoe as viewed from the lateral foot side.

FIG. 3 is a perspective view of the shoe 300 as viewed from the lateral foot side. In the circumferential side surface of the midsole 120, the third groove portion 123 is provided on a lateral-foot-side side surface 125 on the lateral foot side so as to traverse obliquely and vertically a slightly forward portion thereof. The third groove portion 123 is a concave portion formed by being dug down from the surrounding area in the foot width direction of the midsole 120. More specifically, the third groove portion 123 extends forward from a bottom-surface-side end portion 123*a* positioned at the boundary on the bottom surface side toward an upper-surface-side end portion 123*b* positioned in the vicinity of the boundary on the upper surface side. When an excessive external force is applied in a twisting direction to the midsole 120, the third groove portion 123 extending forward in this manner functions to suppress excessive bending of the midsole 120 by the first groove portion 111 and the second groove portion 122.

In the present embodiment, in consideration of design, the outline of the third groove portion 123 is formed into a triangular shape with the bottom surface side as the base as indicated by the dotted line. From the viewpoint of functionality, the third groove portion 123 may simply have a linear outline.

A groove width $W_{bo}$ at the lateral-foot-side end portion 111*b* of the first groove portion 111 and a groove width $W_{so}$ at the bottom-surface-side end portion 123*a* of the third groove portion 123 are set so as to at least partially overlap with each other along a direction of a boundary line $C_2$ (indicated by the dash-dotted line) between the bottom surface 112 and the lateral-foot-side side surface 125. In other words, the lateral-foot-side end portion 111*b* of the first groove portion 111 and the bottom-surface-side end portion 123*a* of the third groove portion 123 share a part of the boundary line $C_2$ with each other. Sharing a part of the boundary line $C_2$ with each other is not limited to the case where the end portions of the two groove portions are at least partially continuously connected to each other, and even in the case where the end portions are not continuously connected to each other, the end portions may be at least partially opposed to each other with the boundary line $C_2$ interposed therebetween. In the case where such a relationship is satisfied, when an external force is applied in a twisting direction to the sole 100 in which the outsole 110 and the midsole 120 are laminated, stress is concentrated on the first groove portion 111 and the third groove portion 123, and the sole 100 is relatively easily twisted along the groove portions. Furthermore, in view of the relationship with the second groove portion 122, stress is concentrated along the second groove portion 122, the first groove portion 111, and the third groove portion 123, and the sole 100 is relatively easily twisted along the groove portions.

Figure 4:
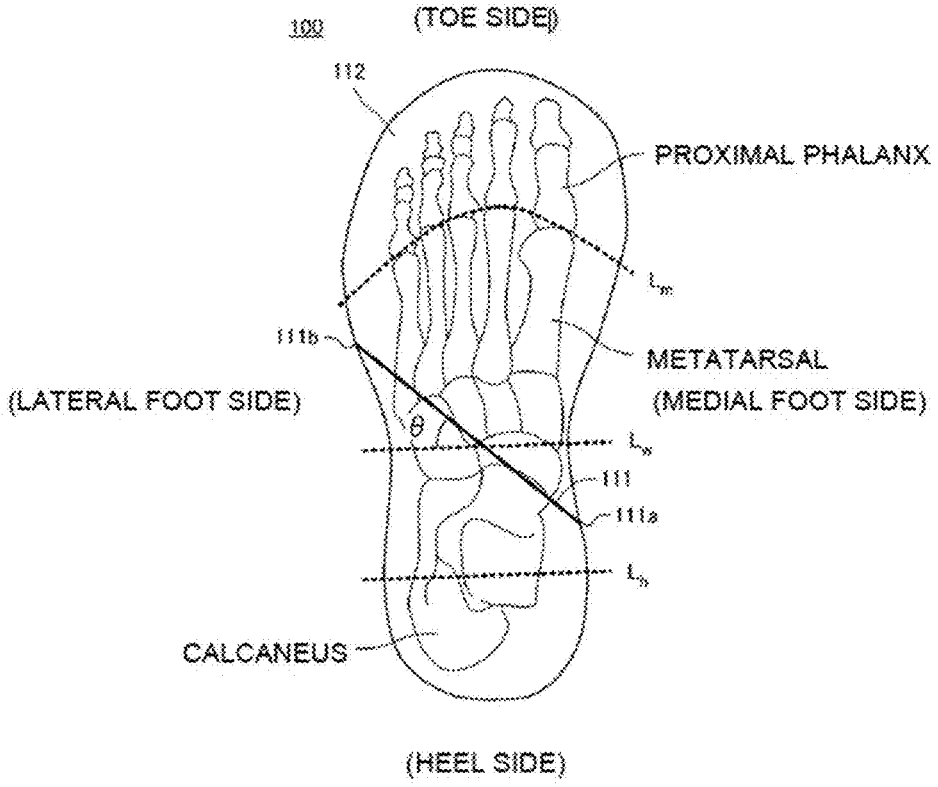
FIG. 4 is a schematic view explaining a configuration of a first groove portion.

FIG. 4 is a schematic view explaining a configuration of the first groove portion 111 in more detail. As described above, the first groove portion 111 is provided so as to extend forward from the medial-foot-side end portion 111*a* positioned at the boundary on the medial foot side toward the lateral-foot-side end portion 111*b* positioned at the boundary on the lateral foot side. In the first groove portion 111 provided in this manner, an angle θ formed by a bending line (specifically, a straight line on which stress is concentrated with respect to an external force, which will be described below) that bends when an external force in a twisting direction is applied and a foot width line $L_w$ that is the narrowest in the foot width direction on the bottom surface 112 is preferably 20° or more and 45° or less.

Moreover, the entirety of the first groove portion 111 having the medial-foot-side end portion 111*a* and the lateral-foot-side end portion 111*b* as both ends is preferably accommodated in a region behind an MTP line $L_m$ corresponding to the metatarsophalangeal joint when the wearer wears the shoe 300 and in front of a calcaneus line $L_h$ set so as to traverse horizontally the front end of the calcaneus. The metatarsophalangeal joint is a joint between the proximal phalanx and the metatarsal, and the calcaneus is a foot bone positioned at the rearmost end. Strictly speaking, these positions are different for each wearer. However, since the shoe 300 is manufactured by being classified according to the size corresponding to the size of the foot of the wearer, the positions approximately coincide with the positions illustrated in the drawing for the wearer wearing the shoe 300 of the same size.

Figure 5:
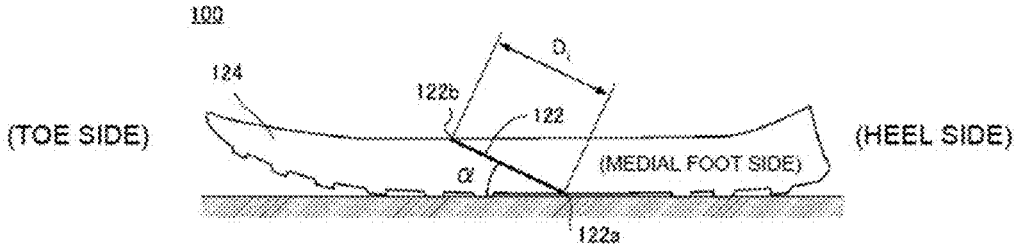
FIG. 5 is a schematic view explaining a configuration of a second groove portion.

FIG. 5 is a schematic view explaining a configuration of the second groove portion 122. As described above, the second groove portion 122 is provided so as to extend forward from the bottom-surface-side end portion 122*a* toward the upper-surface-side end portion 122*b* of the midsole 120. In the second groove portion 122 provided in this manner, an angle α formed by a bending line (similarly to the bending line of the first groove portion 111, a straight line on which stress is concentrated with respect to an external force) that bends when an external force in a twisting direction is applied and the ground contact surface is preferably 20° or more and 45° or less.

Figure 6:
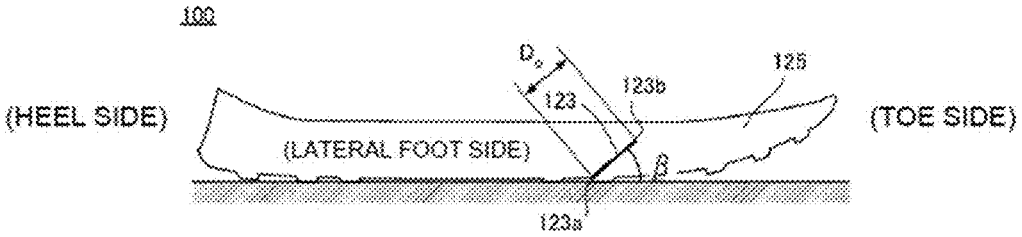
FIG. 6 is a schematic view explaining a configuration of a third groove portion.

FIG. 6 is a schematic view explaining a configuration of the third groove portion 123. As described above, the third groove portion 123 is provided so as to extend forward from the bottom-surface-side end portion 123*a* toward the upper-surface-side end portion 123*b* of the midsole 120. In the case where the third groove portion 123 provided in this manner functions to suppress bending of the midsole 120, an angle β formed by a bending line (similarly to the bending line of the first groove portion 111, a straight line on which stress is concentrated with respect to an external force) that bends when an external force in a twisting direction is applied and the ground contact surface is preferably larger than the angle α formed by the bending line of the second groove portion 122 and the ground contact surface.

Moreover, a length $D_i$ of the bending line of the second groove portion 122 in the extending direction illustrated in FIG. 5 is preferably longer than a length $D_o$ of the bending line of the third groove portion 123 in the extending direction illustrated in FIG. 6. In such a relationship, the function of promoting bending of the sole 100 by the second groove portion 122 can be appropriately suppressed and balanced by the third groove portion 123. As illustrated in FIG. 6, the upper-surface-side end portion 123*b* of the third groove portion 123 does not necessarily have to reach the boundary on the upper surface side, but the upper-surface-side end portion 123*b* of the third groove portion 123 may be positioned at the end portion on the upper surface side of the midsole 120 as long as such a relationship of the lengths is satisfied.

Figure 7:
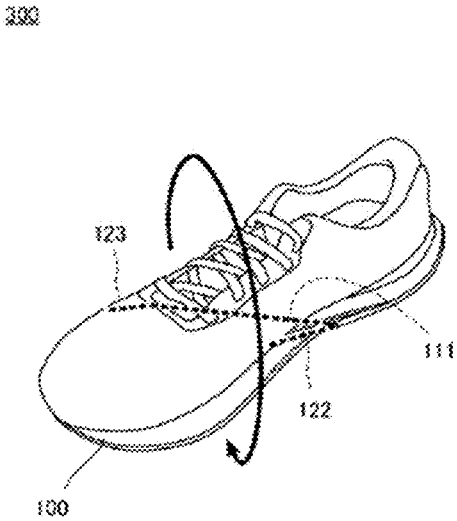
FIG. 7 is an overall perspective view of the shoe for explaining the effect of the three groove portions.

When the first groove portion 111, the second groove portion 122, and the third groove portion 123 are formed in the shoe 300 so as to satisfy the conditions described with reference to FIGS. 2 to 6, a better effect is achieved when the wearer runs on an uneven ground. FIG. 7 is an overall perspective view of the shoe 300 for explaining the effect of these three groove portions.

As indicated by the broken line, the first groove portion 111, the second groove portion 122, and the third groove portion 123 function as a three-dimensional, substantially continuous, and integrated groove portion for the sole 100. When the wearer runs on an uneven ground on which stone blocks, twigs, and the like are scattered, with respect to the stepping of the wearer, the sole bottom surface is subjected to dispersing action in which a reaction force is received locally or is not received at all due to bumps and dips on the road surface. At this time, in the case of a shoe having a hard sole which does not bend, the entire sole bottom surface follows the bumps and dips on the road surface as a flat surface. Therefore, the bottom of the wearer's foot is inclined along such a sole bottom surface, and the direction in which the wearer steps and the feeling received by the ankle do not coincide with each other, and the wearer feels discomfort. In other words, the wearer feels that he or she cannot freely control the shoe.

Such a feeling reminds the wearer of uneasiness or fear for running, and causes a decrease in running speed.

On the other hand, in the shoe 300 according to the present embodiment, the three groove portions integrally function, so that the sole 100 is relatively easily twisted in a direction indicated by the thick arrow in the drawing. The sole 100 is twisted and deformed in such a direction, so that the sole bottom surface more flexibly follows the bumps and dips on the road surface without the toe portion and the heel portion floating with respect to the bumps and dips on the road surface.

In particular, since the first groove portion 111 is provided so as to extend forward from the medial foot side toward the lateral foot side and the second groove portion 122 is provided so as to extend forward from the bottom surface side toward the upper surface side of the sole on the medial-foot-side side surface, the sole 100 bends while being divided into a portion corresponding to the region centered on the ball of the foot of the wearer and a portion corresponding to the region centered on the heel. Accordingly, the wearer can maintain the horizontal position of the ankle more easily, and the direction in which the wearer steps and the feeling received by the ankle coincide with each other more easily. In other words, the wearer feels that he or she can freely control the shoe.

Moreover, since the sole bottom surface more flexibly follows the bumps and dips on the road surface, it is possible to appropriately disperse the impact with respect to the stepping of the wearer, and the load on the ankle is also reduced.

Figure 8:
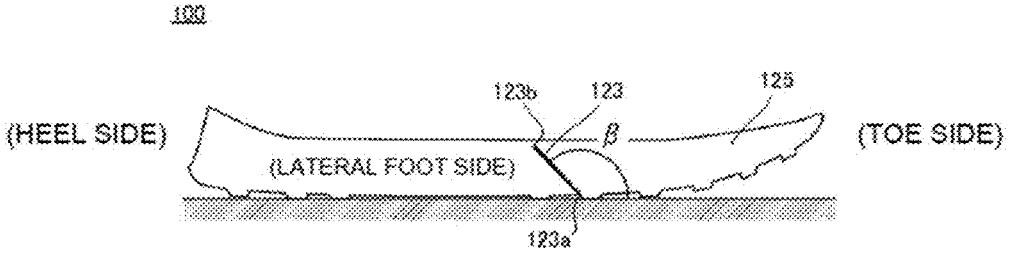
FIG. 8 is a schematic view explaining a configuration of the third groove portion according to a modification.

Depending on the performance required for the shoe 300, the larger the twist in the direction indicated by the thick arrow, the more preferable. In this case, the direction in which the third groove portion 123 is provided may be changed. FIG. 8 is a schematic view explaining a configuration of the third groove portion 123 according to a modification. As illustrated in the drawing, when the third groove portion 123 extends rearward from the bottom-surface-side end portion 123*a* toward the upper-surface-side end portion 123*b*, the third groove portion 123 functions to further improve the bending effect by the first groove portion 111 and the second groove portion 122. At this time, when the angle formed with respect to the ground contact surface is represented by β as in FIG. 6, 180°>β>90° is defined.

Figure 9A:
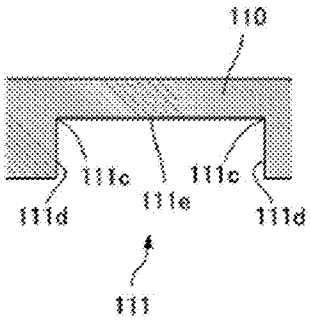
FIGS. 9A to 9D are cross-sectional views of the first groove portion for explaining variations of a groove structure.

Next, a groove structure will be described. FIG. 9A to 9D are cross-sectional views of the first groove portion 111 for explaining variations of the groove structure. As illustrated in FIG. 9A, the cross section has a rectangular shape as a general groove structure. When the cross section has a rectangular shape, stress-concentrating portions 111*c* in which stress is concentrated at the time of twisting appear at the boundary between one sidewall 111*d* and a groove bottom surface 111*e* and at the boundary between the other sidewall 111*d* and the groove bottom surface 111*e*. Since the stress-concentrating portions 111*c* are formed along the extending direction of the first groove portion 111, the bending line of the first groove portion 111 can be defined as at least one of the stress-concentrating portions 111*c*.

Figure 9B:
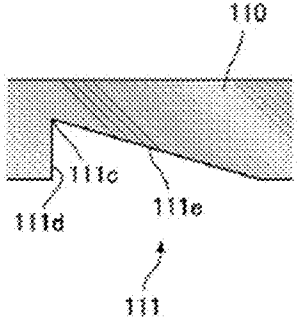

As illustrated in FIG. 9B, a triangular cross section can also be adopted. In this case, the stress-concentrating portion 111*c* in which stress is concentrated at the time of twisting appears at the boundary between the sidewall 111*d* and the groove bottom surface 111*e* formed as an inclined surface. Since the stress-concentrating portion 111*c* is also formed along the extending direction of the first groove portion 111, the bending line of the first groove portion 111 can be defined as the stress-concentrating portion 111*c* extending in this manner. In the example of the drawing, an example in which a triangular cross section is formed by the vertical sidewall 111*d* and the inclined groove bottom surface 111*e* is illustrated, but a V-shaped cross section formed by two inclined groove bottom surfaces 111*e* may be adopted.

Figure 9C:
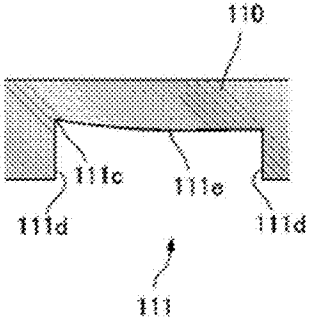
Figure 9D:
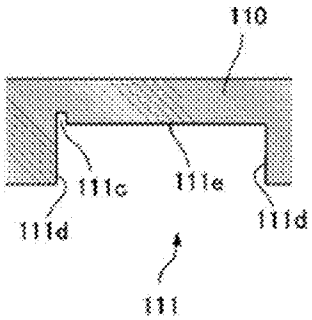

The examples of FIGS. 9C and 9D are modifications of FIG. 9A. In the example of FIG. 9A, two bending lines can be defined, but in the examples of FIGS. 9C and 9D, even when the cross section has a substantially rectangular shape, one of the boundaries is defined as a bending line. Specifically, in the example of FIG. 9C, the groove bottom surface 111*e* is curved in the vicinity of one boundary, thereby forming the stress-concentrating portion 111*c* in which stress is more likely to be concentrated. In the example of FIG. 9D, a notch is provided in the groove bottom surface 111*e* in the vicinity of one boundary, thereby forming the stress-concentrating portion 111*c* in which stress is more likely to be concentrated. The cross-sectional shape is not limited to these examples, and may be variously modified. Which cross-sectional shape is to be adopted can be determined on the basis of the degree of bending and design required for the shoe 300. In the above description, the first groove portion 111 has been described as an example, but the cross-sectional shapes of the second groove portion 122 and the third groove portion 123 are the same.

Figure 10:
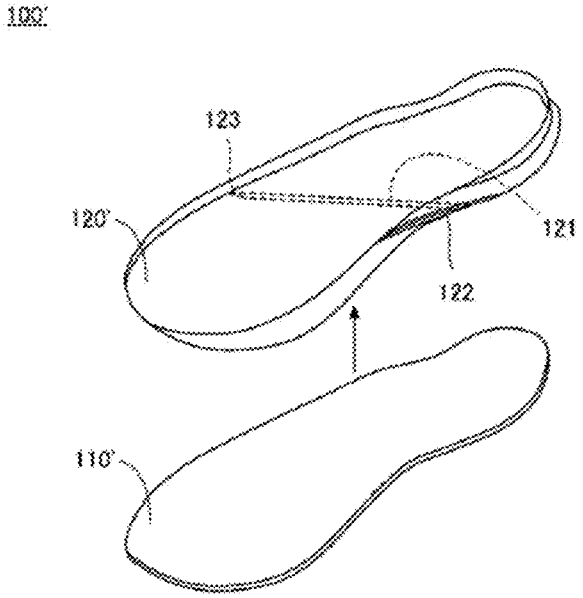
FIG. 10 is an exploded perspective view explaining a structure of a sole according to a modification.

Next, a modification of the sole 100 will be described. FIG. 10 is an exploded perspective view explaining a structure of a sole 100' according to the modification. In the sole 100, the first groove portion 111 is formed in the outsole 110, and the second groove portion 122 and the third groove portion 123 are formed in the midsole 120, but in the sole 100', all three groove portions are formed in a midsole 120'. Therefore, no groove portion is formed in an outsole 110'. However, similarly to the outsole 110, the outsole 110' may have the through holes 113 and raised portions in consideration of design and functionality.

A first groove portion 121 provided in the midsole 120' can be formed at the same position and with the same structure as the first groove portion 111 provided in the outsole 110. However, the first groove portion 121 formed in the midsole 120' can be formed to be deeper than the first groove portion 111 provided in the outsole 110 which is relatively thin as a whole. Therefore, in order to make the entire sole be twisted more easily, it is effective to form the first groove portion 121 in the midsole 120' in this manner. Furthermore, since the first groove portion 121 can be covered with the outsole 110', it is possible to prevent gravel or the like from being caught.

The structure of the sole is not limited to the example described above. For example, the first groove portion may be formed deep enough to penetrate the outsole 110 and reach the midsole 120. Moreover, the groove portions may be formed in a sole having a single-layer structure instead of the two-layer structure of the outsole 110 and the midsole 120. Furthermore, depending on the required degree of bending, a configuration in which only the first groove portion and the second groove portion are provided without providing the third groove portion may be adopted. On the contrary, in addition to the first groove portion, the second groove portion, and the third groove portion, a groove portion for reinforcing the bending performance may be further added.

In addition, although the shoe 300 according to the present embodiment described above is a shoe mainly intended for trail running, the sole structure as described above can be applied to various shoes for walking on an uneven ground.

What is claimed is:

1. A shoe comprising:

a first groove that continuously extends forward throughout its entire length in an extending direction from a medial foot side end portion to a lateral foot side end portion on a bottom surface of a sole; and a second groove that extends forward from a bottom surface side toward an upper surface side of the sole on a medial-foot-side side surface of the sole, wherein a groove width at a medial-foot-side end portion of the first groove and a groove width at a bottom-surface-side end portion of the second groove at least partially overlap with each other along a direction of a boundary between the bottom surface and the medial-foot-side side surface such that the sole is able to twist three-dimensionally.

2. The shoe according to claim 1, wherein the first groove forms an angle of 20° or more and 45° or less with respect to a foot width line that is the narrowest in a foot width direction on the bottom surface.

3. The shoe according to claim 1, wherein the first groove is adapted to be located in a region behind a metatarsophalangeal joint of a wearer and in front of a calcaneus of the wearer.

4. The shoe according to claim 1, wherein the first groove has a stress-concentrating portion disposed along the extending direction and in which stress is concentrated when the sole is twisted, and the stress-concentration portion is defined by a boundary between a sidewall of the first groove and a groove bottom surface of the first groove.

5. The shoe according to claim 1, wherein the second groove forms an angle of 20° or more and 45° or less with respect to a ground contact surface.

6. The shoe according to claim 1, comprising:

a third groove that extends from the bottom surface side toward the upper surface side of the sole on a lateral-foot-side side surface of the sole, wherein a groove width at a lateral-foot-side end portion of the first groove and a groove width at a bottom-surface-side end portion of the third groove at least partially overlap with each other along a direction of a boundary between the bottom surface and the lateral-foot-side side surface.

7. A shoe comprising:

a first groove portion that extends forward from a medial foot side toward a lateral foot side on a bottom surface of a sole;

a second groove portion that extends forward from a bottom surface side toward an upper surface side of the sole on a medial-foot-side side surface of the sole, and a third groove portion that extends from the bottom surface side toward the upper surface side of the sole on a lateral-foot-side side surface of the sole, wherein a groove width at a medial-foot-side end portion of the first groove portion and a groove width at a bottom-surface-side end portion of the second groove portion at least partially overlap with each other along a direction of a boundary between the bottom surface and the medial-foot-side side surface, a groove width at a lateral-foot-side end portion of the first groove portion and a groove width at a bottom-surface-side end portion of the third groove portion at least partially overlap with each other along a direction of a boundary between the bottom surface and the lateral-foot-side side surface, and a length of the second groove portion in an extending direction is longer than a length of the third groove portion in an extending direction.

8. A shoe comprising:

a first groove portion that extends forward from a medial foot side toward a lateral foot side on a bottom surface of a sole;

a second groove portion that extends forward from a bottom surface side toward an upper surface side of the sole on a medial-foot-side side surface of the sole, and a third groove portion that extends from the bottom surface side toward the upper surface side of the sole on a lateral-foot-side side surface of the sole, wherein a groove width at a medial-foot-side end portion of the first groove portion and a groove width at a bottom-surface-side end portion of the second groove portion at least partially overlap with each other along a direction of a boundary between the bottom surface and the medial-foot-side side surface, a groove width at a lateral-foot-side end portion of the first groove portion and a groove width at a bottom-surface-side end portion of the third groove portion at least partially overlap with each other along a direction of a boundary between the bottom surface and the lateral-foot-side side surface, and an angle formed by the third groove portion with respect to a ground contact surface is larger than an angle formed by the second groove portion with respect to the ground contact surface.

9. The shoe according to claim 1, wherein the sole has a first layer arranged on the bottom surface side and a second layer laminated on an upper surface of the first layer, and the first groove is formed in the first layer, and the second groove is formed in the second layer.

10. The shoe according to claim 9, wherein the second layer has an exposed portion exposed to the bottom surface side through a through hole provided in the first layer, and the first groove is formed to include at least a part of the exposed portion.

11. The shoe according to claim 1, wherein the sole has a first layer arranged on the bottom surface side and a second layer laminated on an upper surface of the first layer, and the first groove is formed in the second layer.

* * * * *